US011403971B2

(12) United States Patent
Grapsa et al.

(10) Patent No.: US 11,403,971 B2
(45) Date of Patent: Aug. 2, 2022

(54) SELF-LOCKING SECURITY SEAL

(71) Applicant: Luciano Grapsa, Leghorn (IT)

(72) Inventors: Luciano Grapsa, Leghorn (IT); Francesco Spagnolo, Rome (IT); Cecilia Occhiuzzi, Rome (IT); Gaetano Marrocco, Montecompatri (IT)

(73) Assignee: Luciano Grapsa, Leghorn (IT)

( * ) Notice: Subject to any disclaimer, the term of this patent is extended or adjusted under 35 U.S.C. 154(b) by 989 days.

(21) Appl. No.: 16/082,987

(22) PCT Filed: Mar. 7, 2017

(86) PCT No.: PCT/IB2017/051311
§ 371 (c)(1),
(2) Date: Sep. 7, 2018

(87) PCT Pub. No.: WO2017/153903
PCT Pub. Date: Sep. 14, 2017

(65) Prior Publication Data

US 2019/0080631 A1 Mar. 14, 2019

(30) Foreign Application Priority Data

Mar. 7, 2016 (IT) ..... 102016000023352

(51) Int. Cl.
*G09F 3/03* (2006.01)

(52) U.S. Cl.
CPC ..... *G09F 3/0352* (2013.01); *G09F 3/0335* (2013.01)

(58) Field of Classification Search
CPC ..... Y10T 292/48; Y10T 292/491; Y10T 292/498; Y10T 292/499; Y10T 292/502; Y10T 292/505; Y10T 292/507; Y10T 292/509; Y10T 292/506; Y10T 292/51; Y10T 292/516; Y10T 24/3969; Y10T 24/6779; Y10T 24/3993; Y10T 24/3996; G09F 3/0352; G09F 3/0335; G09F 3/00; G09F 3/03; G09F 3/0329; G09F 3/0347; G09F 3/0376; G06K 19/07798; G06K 19/07726; E05B 45/005; E05B 67/003; E05B 73/0017; E05B 73/0029; E05B 73/0005; F16G 11/10; F16G 11/105; F16G 11/106; F16G 11/108
See application file for complete search history.

(56) References Cited

U.S. PATENT DOCUMENTS 5,230,541 A * 7/1993 Nowak ..... E05C 19/18 24/16 PB
5,647,620 A 7/1997 Kuenzel
(Continued)

FOREIGN PATENT DOCUMENTS

| | | | |
|---|---|---|---|
| EP | 2590154 | A1 | 5/2013 |
| WO | 2006085735 | A1 | 8/2006 |
| WO | 2014053551 | A1 | 4/2014 |

OTHER PUBLICATIONS

International Search Report and Written Opinion for International Application No. PCT/IB2017/051311 (12 Pages) (dated May 26, 2017).

*Primary Examiner* — Alyson M Merlino
(74) *Attorney, Agent, or Firm* — Lucas & Mercanti, LLP

(57) ABSTRACT

The present invention relates to a self-locking security seal of the type mostly used within the scope of transporting goods, for the secure closure of containers or the like.

15 Claims, 4 Drawing Sheets

(56) References Cited

U.S. PATENT DOCUMENTS

| | | | | |
|---|---|---|---|---|
| 7,104,092 | B2 * | 9/2006 | Yu | E05B 67/003 70/21 |
| 7,239,238 | B2 * | 7/2007 | Tester | G06K 19/07798 292/307 R |
| 7,825,811 | B2 * | 11/2010 | Chan | E05B 45/005 340/572.9 |
| 8,963,712 | B2 * | 2/2015 | Mullis | G06K 19/07798 340/542 |
| 9,121,195 | B2 * | 9/2015 | Mullis | G09F 3/0329 |
| 9,624,692 | B2 * | 4/2017 | Mullis | G06K 19/07798 |
| 9,745,782 | B2 * | 8/2017 | Mubarak | G06K 19/07798 |
| 2005/0193783 | A1 * | 9/2005 | Zovic | G09F 3/0352 70/69 |
| 2006/0152364 | A1 * | 7/2006 | Walton | G06K 19/07798 340/568.1 |
| 2008/0036596 | A1 * | 2/2008 | Auerbach | G09F 3/0329 340/542 |
| 2014/0167964 | A1 * | 6/2014 | Teeter | G06K 19/07798 340/572.3 |
| 2015/0337564 | A1 * | 11/2015 | Mubarak | E05B 73/0005 340/542 |

* cited by examiner

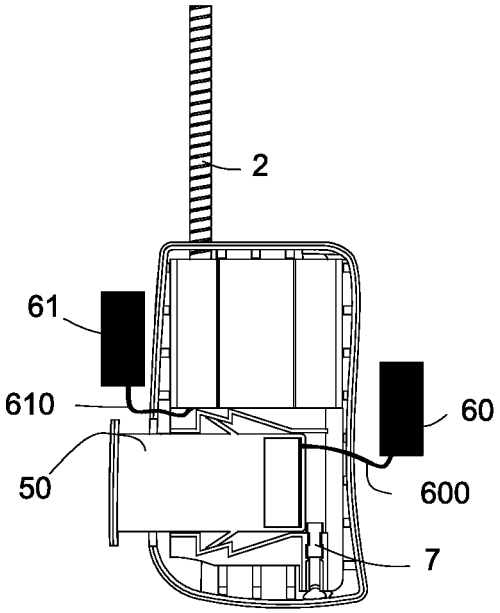
Fig.8
Fig.9
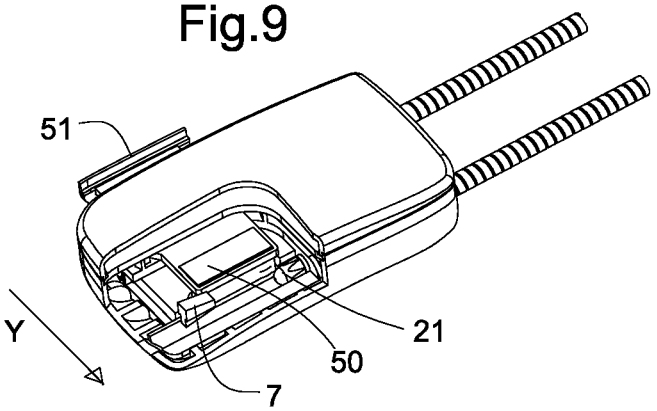

SELF-LOCKING SECURITY SEAL

CROSS-REFERENCE TO RELATED APPLICATIONS

This application is a 371 of PCT/IB2017/051311, filed Mar. 7, 2017, which claims the benefit of Italian Patent Application No. 102016000023352, filed Mar. 7, 2016.

TECHNICAL FIELD OF THE INVENTION

The present invention relates to a self-locking security seal. Such seals are mostly used within the scope of transporting goods, for the secure closure of containers or the like.

BACKGROUND OF THE INVENTION

These seals are placed on the container when it is closed, especially in the form of security and as a confirmation that the goods contained inside have not been tampered with. Indeed, to be removed, such seals are to be seriously and irremediably tampered with so that the opening thereof is apparent. Therefore, if the seal reaches the final destination tampered with, this is a clear signal that the container has been tampered with and that the goods therein have been removed or damaged.

Various types of seals exist on the market. Known ones include self-locking seals with a steel cable and aluminium tightening block, such as the ones for example of Italian Patent no. LI2014U000006 and no. LI2014U000009 of the same Applicant. Briefly, these seals comprise an aluminium block in which a steel cable is irreversibly inserted in order to close the container. To open the seal, the steel cable is to be cut. Similar locking mechanisms are described in the PCT Patent Application WO2006085735 and in the U.S. Pat. No. 5,647,620.

Self-locking seals with steel cables have several advantages and are particularly appreciated in the field both because they are highly resistant to tampering and because tampering in any case is particularly apparent. Moreover, such seals may incorporate detection systems taking advantage of RFID (i.e. Radio Frequency Identification) technology, that is systems capable of remotely signalling the possible tampering of the seal. An example of such a solution is described in PCT Patent Application WO2014053351.

However, such seals still have margins for improvement, especially with regards to resistance to tampering.

For example in WO2014053351, in at least one of the three conditions of the seal, i.e. open, closed and tampering, there is an absence of the signal of one of the RFID tags. However, such a solution has the disadvantage of an intrinsic vagueness of the information because the absence of the signal not only may be due to the condition of a tampering, but due also for example, to a malfunctioning of the tag.

SUMMARY OF THE INVENTION

It is therefore the object of the present invention to provide a self-locking security seal installing detection RFID technology which is improved with respect to the previous versions, and in particular which absolutely is resistant to tampering.

It is again an object of the invention to make absolutely apparent any tampering so that it is possible to check the load quickly in order to identify the persons responsible.

BRIEF DESCRIPTION OF THE DRAWINGS

The features and advantages of the seal according to the invention shall be apparent from the description below of an embodiment thereof, made by way of a non-limiting example, with reference to the accompanying drawings in which:

FIG. 6 shows the seal with a false cable partly inserted in the main body, FIG. 7 shows the seal with cable cut;

FIG. 8 shows first and second detection RFID means connected to anti-tampering means and safety means of the seal, respectively;

FIG. 9 is a cut-out view of the seal in which there are shown in detail the safety means in FIG. 8.

DETAILED DESCRIPTION OF THE INVENTION

Figure 1:
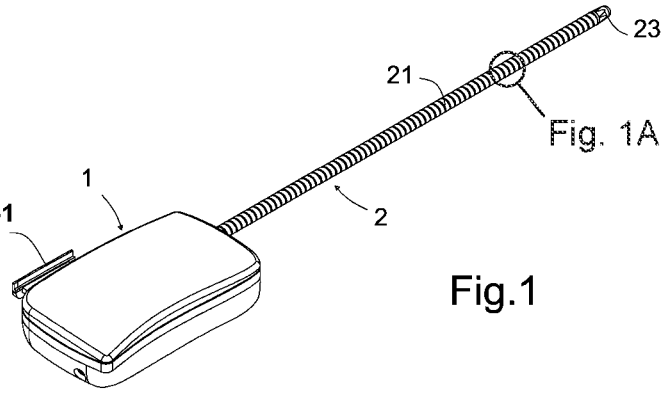
FIG. 1 shows a first embodiment of a security seal showing a main body of the seal and a free end of a cable associated with said main body, the seal moreover being open, i.e. with such a free end not inserted in the main body.
Figure 2:
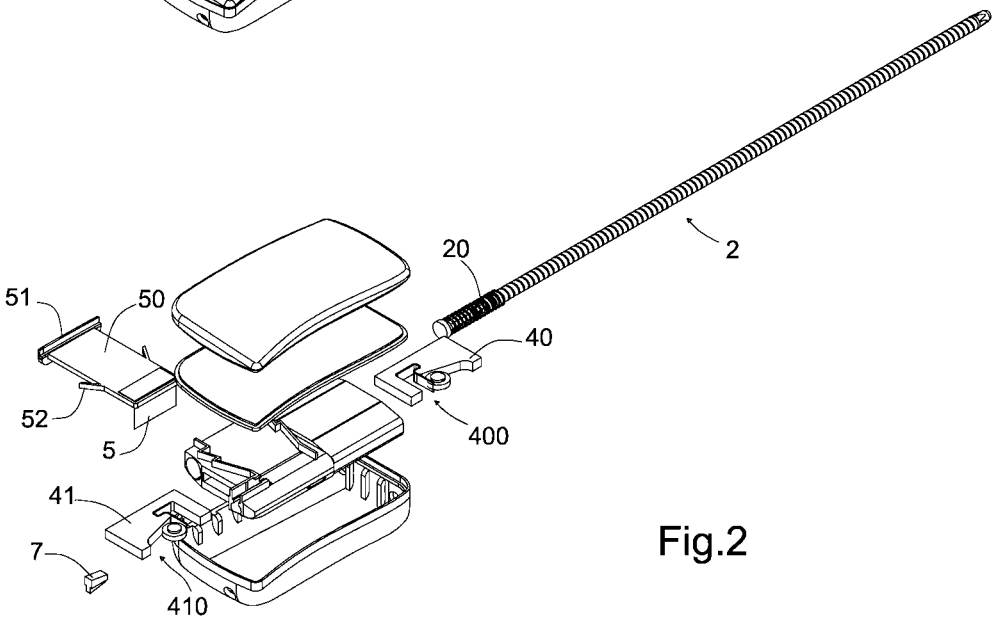
FIG. 2 shows an exploded view of the seal in FIG. 1.

With reference to said drawings, and in particular to FIGS. 1 and 2, the security seal comprises a main body or case 1. The case is made e.g. of plastic material. Associated with the main body is a cable 2, preferably made of metal and in particular, but not exhaustively, made of steel.

A first end 20 of the cable is bound integrally to the main body while a second end or free end 21 extends from the main body 1 with open seal, and is such as to be engaged within the main body itself to achieve the closure of the seal. With seal closed, a portion of cable 22 remains outside the main body 1 (see e.g. FIG. 3) to be engaged with a hook placed on the container to be sealed. Inside the main body is defined a channel 3, in which the free end 21 is adapted to be inserted, according to a direction of insertion X, to achieve the closure of the seal.

In greater detail, within the main body are housed two secondary bodies or blocks 40, 41, they also made of metal and preferably but not exhaustively of aluminium, mutually spaced apart to define therebetween the above-mentioned channel 3.

With regard to the invention, the seal comprises a first locking device or upper locking device 400 which prevents the downwards movement of the free end 21 of the cable 2 within the channel 3, i.e. in the direction of insertion X. The upper locking device 400 comprises a spring 401 fixed to the block 40 and a retaining element 402 supported at its head by the spring itself. The locking of the free end is obtained due to the effect of the abutment of the retaining element against the cable when it is inserted in the channel.

Figure 3:
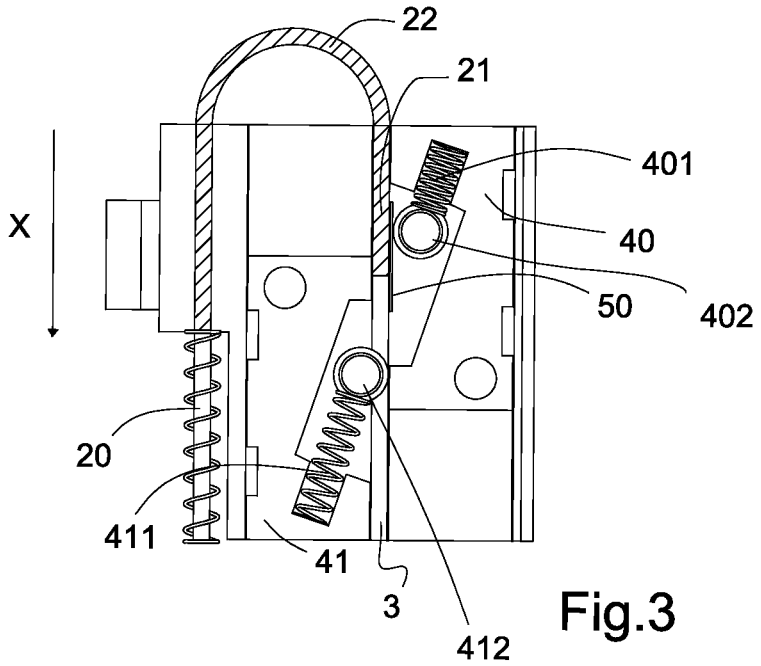
FIG. 3 is a view of the inside of the main body of the seal according to the first embodiment, with the functional elements depicted diagrammatically for clarity.
Figure 4:
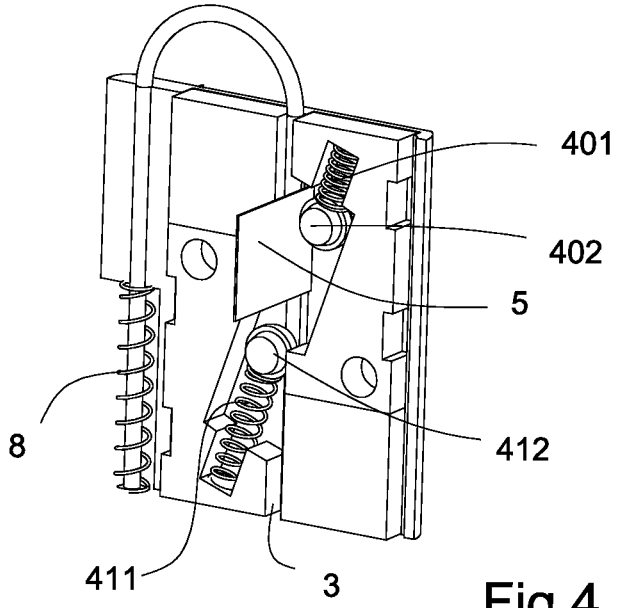
FIG. 4 is a perspective view of the seal in FIG. 3.
Figure 5:
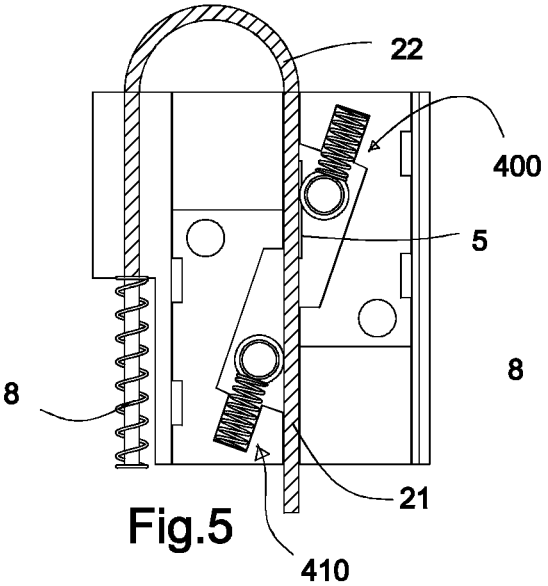
FIG. 5 is a front view again of the seal in FIGS. 3 and 4, with the free end of the cable completely inserted.
Figure 7:
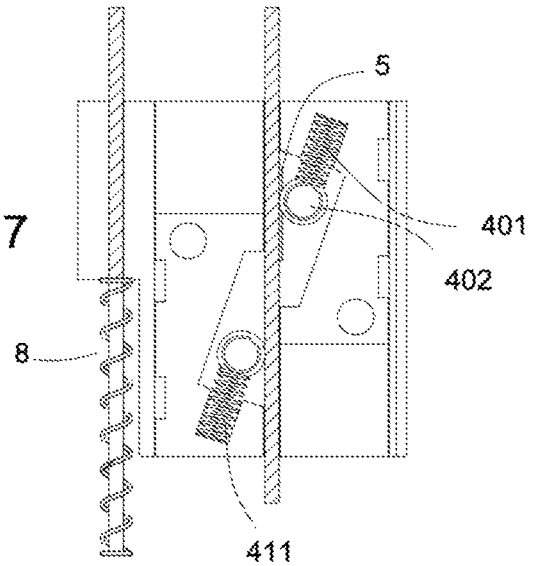

The first locking device 400 is reversibly engaged with safety means 5 and is movable between a rest position in which it does not interfere with the free end 21 of the cable in the channel 3, and a position of interference with the free end of the cable 21 within the channel 3. The movement of the upper locking device 400 between such two positions is caused by the removal of the engagement with the above-mentioned safety means 5. In detail, in open seal configuration with cable not inserted, the spring 401 is in compression due to the effect of the safety means 5, which engage therewith (FIGS. 3, 4, and 5). The removal of the safety means allows the extension of the spring 401 which causes the abutment of the retaining element 402 with the free end of the cable within the channel 3, thus causing the locking of the cable in the direction of insertion X (FIG. 7).

Connected to the safety means 5 are first RFID detection means 60 or detection RFID means (FIG. 8). These preferably are materialized by an RFID tag or one gate of a two-gate RFID tag. The first RFID detection means 60 are connected to the safety means 5 by means of a frangible electrical connection 600 (shown only diagrammatically in FIG. 8). When the safety means 5 are disengaged from the first locking device, the frangible electrical connection is interrupted and this induces the activation, i.e. the change of state of the RFID tag, according to a logic signal like EPC+Open/Close bit (1/0), where EPC is the identifying signal of the tag, while the Open/Close bit is a signalling bit of the change of state. The activation of the tag therefore implies the detection of the condition of seal closed. In absence of signal (with the safety means not removed), the state of the tag corresponds to the condition of seal open.

With particular reference now to FIGS. 2 and 9, the safety means 5 comprise a tab which extends parallel and peripherally to the channel 3, according to the direction X. The tab extends perpendicularly from a free end of a plate 50 placed within the main body of the seal in overlapping position with respect to the blocks, so as to support the tab in position of interference with the upper locking device. The other free end of the plate protrudes from case 1, thus materializing a button 51. Due to the effect of a push exerted on the button 51, the plate 50 slides towards the inside of the case, i.e. towards the channel 3 according to a direction perpendicular to the above-mentioned direction X. The sliding of the plate according to Y induces the removal of the security tab 5 so that it does not interfere with the retaining element. In one possible variant, the tab has a given flexibility and the sliding of the plate according to Y corresponds to the bending thereof towards the plate itself.

Obtained on the sides of the plate are two flaps 52 which allow the sliding thereof only according to the direction Y, thus preventing the return thereof. Advantageously therefore, once the button 51 has been pressed and the tab 5 has been moved, it is no longer possible to bring the seal back to the original state.

To avoid the accidental activation of the button 51 also without the cable inserted, there are provided stop means 7 which interfere with the plate to prevent the sliding thereof in the direction Y.

In detail, the stop means comprise a locking pin 7 which slides inside the channel 3 according to the direction of insertion of the cable X. With the seal not active, the cable not inserted, the pin 7 is in such a position as to interfere with the free end of the plate 50 so as to prevent the sliding thereof according to Y. The introduction of the free end of 21 of the cable 2 causes the contextual downwards push of the pin 7, according to the direction of insertion X, thus freeing the plate. At this point, a user may press the button 51, disengage the tab 5 and activate the upper locking device 400 on one side, thus preventing the movement of the cable within the channel, thus on the other side activating the first RFID detection means.

Advantageously, the seal according to the invention may possibly also provide a second locking device or lower locking device 410 adapted to interfere within the channel 3 within the free end 21 to block the movement thereof also in direction opposite to the one of insertion X. I.e., the second locking device 410 prevents the extraction of the free end of the cable from the channel 3.

The second locking device 410 comprises a spring 411 secured to the respective second block 41 and a retaining element 412 supported at its head by the spring itself. In condition of open seal with cable not inserted (FIGS. 3 and 4), the spring 411 is extended; the insertion of the free end of cable 21 in the channel 3 therefore induces the compression thereof (FIG. 5); the spring in compression therefore pushes the retaining element onto the cable itself, thus blocking the upwards return movement thereof.

According to that described above, the operation of the seal therefore is the following: the first locking device initially is in the rest condition. The free end of the cable therefore may be inserted into the channel and such an insertion causes the engagement with the lower locking device. Such an engagement implies the impossibility of extracting the cable from the channel. However, considering that the first locking device is resting, the cable may still be moved in the direction of insertion X in order to adjust the length of the portion 22 outside the body, according to the closure to be sealed. Once such a length has been adjusted, the safety means may be removed and the upper locking device activated so as to obtain the complete locking of the cable within the channel, both in the direction X and in the opposite direction.

Figure 1A:
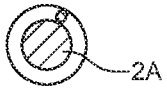
FIG. 1A shows a cross-sectional view of the cable shown in FIG. 1.

Again, the cable 2 may possibly be a cable like the one described in Italian patent applications no. LI2014U000006 and no. LI2014U000009 of the same applicant. Here, the cable comprises an outer sheath, preferably made of metal such as e.g., spiral steel, which houses an anti-tampering wire 2A (shown in FIG. 1A) made of plastic material (such as e.g., nylon) or metal (e.g. steel). At the free end of the cable, the wire is blocked by a bushing 23. At the end 20 connected to the seal, the wire 2A instead is connected to anti-tampering means 8 materialized by an anti-tampering spring connected to the end of the anti-tampering wire 2A. When the anti-tampering spring is resting, i.e., seal not tampered with, it is in the state of compression. If instead the cable is cut (and with it accordingly, also the wire 2A inside), the spring 8 snaps, extends.

Connected to the anti-tampering spring 8 by means of a second frangible electrical connection 610 depicted diagrammatically in FIG. 8, are second RFID detection means 61 materialized e.g. by an RFID tag or by one gate of a two-gate RFID tag. When the cable is cut and this anti-tampering spring 8 snaps, the connection 610 with the second RFID detection means fractures and this induces a change of state of the RFID tag. Such a change of state, which materializes in a logic signal like EPC+tampering bit (1,0), where the tampering bit is a bit which detects the fracture of the cable, therefore the state of seal tampered with.

Advantageously therefore, including also the second RFID detection means, there may be wirelessly detected three conditions of the seal, i.e. the condition of seal open, the condition of seal closed and the condition of seal tampered with.

Figure 6:
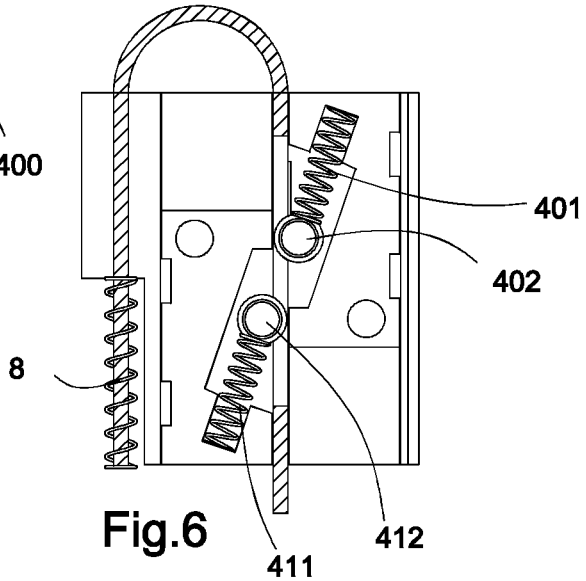
FIGS. 6 and 7 diagrammatically show the seal in the preceding FIGS. 3 to 5 in two different tampering configurations, in detail

In detail, it is worth noting the case in which in the channel 3 is inserted a false cable, for example a stretch of cable like the one shown in FIG. 6, to deceive the operator performing the check that the seal is closed. If the safety means 5 are not removed (because for example, the intention is to extract such a false cable and replace it after performing the tampering with an authentic cable), first RFID detection means will not modify their state, thus indicating the seal as open. Contrarily, if instead a false cable is inserted but the safety means are removed, the second RFID tag will indicate the condition of seal closed but due to the presence of the first and the second locking device, the cable will no longer be able to be removed and therefore the tampering will be apparent.

Again, if instead the cable is cut after being inserted in the channel and the security tab is freed, both passive detection RFID means are activated, thus signalling the tampered seal in condition of closing.

The seal according to the present invention has several advantages.

The seal allows the condition of open or closed seal to be detected automatically and by means of passive detection RFID technology. Moreover, the seal may also detect the condition of a tampering with the anti-tampering means and the second detection RFID means. In particular, the detection means are capable of communicating the states of the seal by means of logic signals like the EPC+Open/Close bit and EPC+tampering bit, i.e. by means of specific logic signals in addition to the EPC identification signal transmitted from the RFID device.

Considering that the present invention allows a communication of the EPC identification signal of the passive RFID detection mean to the RFID reader to be obtained for all three conditions of the seal, this allows the failed communication of the RFID due to simple malfunctioning, to be excluded. As mentioned above, the information on the condition of the seal (open, closed or tampering) is coded in two additional states of the signal, i.e. in the "Open/Close" bit and in the "Tampering" bit. Such a solution therefore ensures increased strength of the wireless control mechanism of the states of the seal because contrary to the above-described background art, the information on the condition of the seal is no longer caused by a simple absence of signal.

The seal proves to be resistant and strong to tampering attempts, in addition to attempts to emulate the cable in position of closure.

The seal is also structurally simple, therefore this implies the maximum ease of manufacturing and assembly, which therefore results in contained production costs. Moreover, the sizes of the seal are contained.

A further advantage again of the seal according to the invention is that it meets the requirements of Standard ISO17712 of 2013, i.e. it meets a series of particularly high security standards.

The present invention was described with reference to a preferred embodiment thereof. It is intended that other embodiments may exist which relate to the same inventive core, all falling within the scope of protection of the claims indicated below.

The invention claimed is:

1. A security seal comprising:

a main body, within which is bound a first end of a cable, and a channel, within which a free end of said cable is adapted to enter in a direction of insertion to obtain a closure of said security seal, said security seal further comprising: a first locking device, movable between a rest position, in which said first locking device is retracted from said channel, and a position of interference within said channel, in which said first locking device interferes with said free end of said cable located within said channel to prevent sliding of the cable in the direction of insertion;

safety means placed in engagement with said first locking device, movement of the first locking device from said rest position to said position of interference being activated by disengagement of said safety means from said first locking device; and first RFID detection means connected to said safety means via a first frangible electrical connection, whereby the disengagement of said safety means from the first locking device causes fracture of said first frangible electrical connection and a change of state of the first RFID detection means is related to the closure of the seal;

wherein said first end of said cable is connected to said main body through anti-tampering means, a second detection RFID means being connected to said anti-tampering means via a second frangible electrical connection, said anti-tampering means being able, due to a cutting of said cable, to break said second frangible electrical connection, said breaking of the second frangible electrical connection resulting in a change of state of said second detection RFID means, correlating to a condition of a tampering of the security seal;

wherein said cable comprises an outer sheath that houses an anti-tampering wire which is connected to said anti-tampering means, so that the cutting of said cable also includes a cutting of said anti-tampering wire; and wherein said anti-tampering means comprise a spring, compressed when said cable and said anti-tampering wire is uncut, said spring extends when said cable and said anti-tampering wire is cut, causing said second frangible electrical connection to break.

2. The security seal according to claim 1, wherein said change of state of said first RFID detection means causes a logic signal as "EPC+Open/Close bit" where EPC is an identification signal of said first detection means.

3. The security seal according to claim 1, wherein said change of state of said second detection RFID means causes a tampering logic signal as EPC+tampering bit.

4. The security seal according to claim 1 wherein said safety means comprise a tab placed within and parallel to said channel.

5. The security seal according to claim 4, wherein said tab extends perpendicularly to one end of a plate of said safety means, another end of said plate, opposite to said one end, extends from said main body, providing an activation button.

6. The security seal according to claim 5, wherein said plate is adapted to slide, due to a push on said activation button, by a user in a direction perpendicular to said direction of insertion, the sliding of the plate causes the disengagement of said tab from said first locking device corresponding to the disengagement of said safety means from said first locking device.

7. The security seal according to claim 6, wherein flaps are formed on sides of said plate so as to be adapted to prevent said plate from sliding in a direction opposite to said direction perpendicular to said direction of insertion.

8. The security seal according to claim 5, wherein a locking pin is slidingly housed in the main body adjacent said channel according to said direction of insertion, said locking pin being movable between a position of interference with said one end of said plate to prevent said plate from accidentally sliding in said direction perpendicular to said direction of insertion and a position of disengagement with said one end of said plate, in order to allow the sliding of said plate in the direction perpendicular to said direction of insertion and the disengagement of said tab from said first locking device.

9. The security seal according to claim 8, wherein said locking pin is moved between said position of interference and said position of disengagement by a push exerted by said free end of said cable during insertion of said cable into said channel in said direction of insertion.

10. The security seal according to claim 1, wherein said first locking device comprises a spring coupled to said main body, said spring supporting at its head a retaining element, said retaining element being adapted to abut against said free end of said cable within said channel and to prevent said free end of said cable from sliding in said direction of insertion due to a push exerted by said spring.

11. The security seal according to claim 10, wherein said spring is maintained in compression by said safety means, the disengagement of said safety means determines the extension of the spring towards said channel.

12. The security seal according to claim 1, further comprising a second locking device adapted to interfere with said free end of said cable within said channel in order to prevent said free end of said cable from sliding in a direction opposite to said direction of insertion.

13. The security seal according to claim 12, wherein said second locking device comprises a spring coupled to said main body, said spring supporting at its head a retaining element, said retaining element being adapted to prevent said free end of said cable from sliding within said channel due to a push exerted by said spring.

14. The security seal according to claim 1, wherein said first and second detection RFID means each comprise one gate of a two-gate RFID tag.

15. The seal according to claim 1, wherein said first and second detection RFID means comprise two separate RFID tags.

* * * * *